United States Patent [19]

McClure et al.

[11] Patent Number: 4,746,773

[45] Date of Patent: May 24, 1988

[54] CONNECTOR FOR AUTOMATICALLY MAINTAINING THE INTEGRITY OF A COMMUNICATIONS NETWORK

[75] Inventors: R. Bruce McClure, Harvard; William P. Lane, Taunton, both of Mass.

[73] Assignee: Apollo Computer, Inc., Chelmsford, Mass.

[21] Appl. No.: 812,197

[22] Filed: Dec. 23, 1985

Related U.S. Application Data

[63] Continuation-in-part of Ser. No. 567,229, Dec. 30, 1983, abandoned.

[51] Int. Cl.[4] ..... H01R 13/00

[52] U.S. Cl. ..... 200/51.09; 200/153 S; 200/305; 200/51.14

[58] Field of Search ..... 200/153 S, 304, 305, 200/51 R, 51.02, 51.05, 51.07-51.14, 50 B; 339/143 R, 88 R, 45 R; 174/35 C, 35 R

[56] References Cited

U.S. PATENT DOCUMENTS

| | | | |
|---|---|---|---|
| 2,127,473 | 8/1938 | Sacco | 200/51.07 |
| 3,475,570 | 10/1969 | Appleton | 200/51.07 |
| 3,585,323 | 6/1971 | Appleton | 200/50 B |
| 3,883,734 | 5/1975 | Joiner et al. | 339/88 R |
| 3,894,205 | 7/1975 | List et al. | 200/51.07 |
| 4,003,618 | 1/1977 | Booty | 339/88 R X |
| 4,087,151 | 5/1978 | Robert et al. | 200/51.1 X |
| 4,152,557 | 5/1979 | Busch et al. | 200/51.09 |
| 4,358,135 | 11/1982 | Tsuge et al. | 200/51.1 X |
| 4,363,941 | 12/1982 | Nelson | 200/1 R |
| 4,438,303 | 3/1984 | Astier | 200/51.1 |
| 4,449,778 | 5/1984 | Lane | 339/143 R |
| 4,507,627 | 3/1985 | Ito et al. | 200/153 S |
| 4,557,545 | 12/1985 | Ohtsuki et al. | 339/143 R |

*Primary Examiner*—Henry J. Recla
*Assistant Examiner*—Ernest G. Cusick
*Attorney, Agent, or Firm*—Hamilton, Brook, Smith & Reynolds

[57] ABSTRACT

Wall mounted connectors are provided in a communications ring network. The connectors join signal carrying lines until a communications node is connected into the network at the connector. When a plug from the node is inserted into the connector socket and rotated, plug contacts on the node plug are brought into contact with fixed, line contacts within the connector. Also, an electrical path through line closing conductors in the connector is broken. When the plug is rotated back and removed from the connector, the ring is again completed through the line closing conductors. The line closing conductors are mounted to a wheel which is driven by the plug. The rotor is positioned within a shielded enclosure formed by two pairs of upper and lower plates connected to the outer conductors of respective coaxial signal lines. A pawl pivoted on a biasing wheel drives the wheel back to the nonrotated position unless the wheel is rotated through half of a full rotation. From that point, the wheel is driven forward to ensure proper connection of the node into the network. In a plug associated with the connector, shielding of the inner conductors of node coaxial wire is enhanced by maintaining an integral length of wire between connections to the inner and outer conductor of the wire.

29 Claims, 18 Drawing Sheets

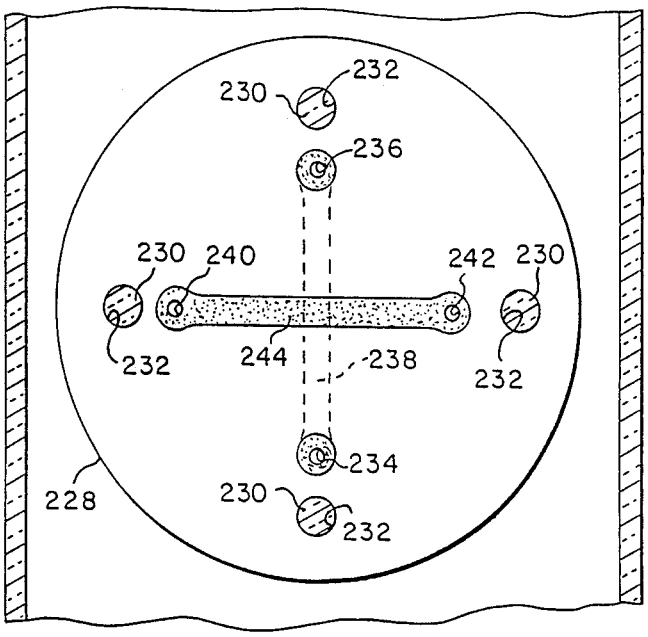
*Fig.16*
*Fig.17*
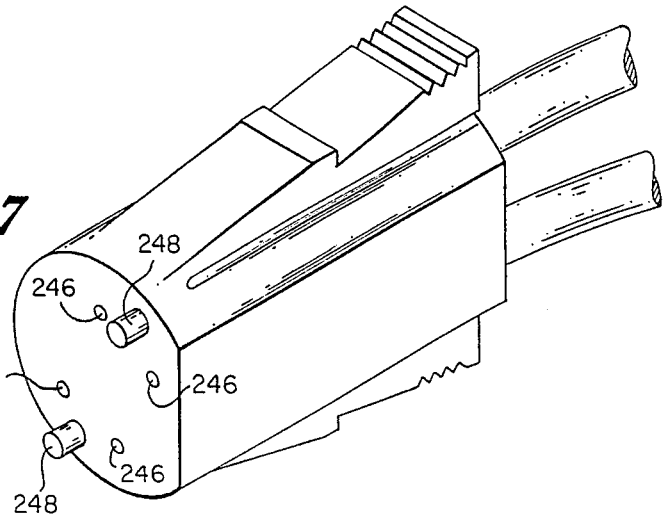

CONNECTOR FOR AUTOMATICALLY MAINTAINING THE INTEGRITY OF A COMMUNICATIONS NETWORK

DESCRIPTION

Related Applications

This is a continuation-in-part of U.S. patent application Ser. No. 567,229, filed Dec. 30, 1983 now abandoned.

FIELD OF THE INVENTION

This invention relates to communications networks to the type in which communications nodes are connected in series in the signal transmitting path and has particular application to ring networks.

BACKGROUND

In ring networks each communications terminal is connected to a signal transmitting ring. Each terminal is referred to as a node of the network. When a node is connected into the network, the ring conductor is broken at that point and reconnected through the node. The node thus becomes an integral part of the data transmission path through the ring.

The integrity of the closed ring, which is necessary for continued communications between the nodes, is broken when a node is removed from the network. The conductors forming the ring must then be reconnected directly in order to again close the ring and allow for continued communications. The integrity of the communications ring is therefore dependent on each user maintaining the integrity of the data transmission path.

DISCLOSURE OF THE INVENTION

A communications network has a plurality of communications nodes interconnected through at least one signal conducting path. The path includes a plurality of node connectors. Each connector includes a line closing conductor therein for closing the network conducting path. Means are also provided for readily connecting and disconnecting a node into the network. Responsive to connection of the node into the network, the path through the line closing conductor is broken. As the node is subsequently disconnected from the network, the network conducting path is automatically completed through the line closing conductor. With this connector, the integrity of the ring at each node location is automatically maintained.

In preferred embodiments, each connector is a wall socket into which a plug from a node fits. The connector includes fixed, line contacts which are connected to respective points of the line forming the ring. Rotatable line closing conductors are also provided in the connector, and when a node is not connected into the ring the line closing conductors bridge the line contacts and thus complete the ring path. When a plug is initially placed in the connector, plug contacts are angularly displaced from associated line contacts. Once inserted into the connector, the plug can be rotated to move the plug contacts into contact with the fixed, line contacts. Responsive to rotation of the plug contacts, the line closing conductors are rotated out of or into contact with the associated line contacts.

In a preferred embodiment, the line contacts and line closing conductors are positioned within a shielded enclosure where connections are made to network coaxial signal lines. The capacitance established by the shielded enclosure impedance matches the connector to the signal lines. The shielded enclosure may be formed by a set of four conductive plates which complete a boxlike enclosure. First parallel upper and lower plates are positioned above and below one coaxial signal line and are electricaly connected to the outer conductor of that line. Second upper and lower plates are positioned in close side-by-side, generally coplanar relationship with the first pair of plates, enclose the second coaxial signal line and are electrically connected to the outer conductor of the second line. Upper line contacts are connected to the inner and outer conductors of the two signal lines and protrude through the upper shield plates where they are exposed to plug contacts. Lower line contacts are provided for making direct connection of the two coaxial signal lines through movable line closing conductors within the shielded enclosure. Preferably, the line closing conductors are mounted to a rotor within the enclosure which is driven through a shaft by a plug moved into contact with the upper line contacts.

Preferably, the coaxial signal lines extend upwardly through holes in the lower shield plates and are bent within the enclosure such that the exposed ends of the inner conductors are oriented parallel to the plates. The outer conductors are clamped between elements carried by upper and lower shield supports. Capacitors are connected between the two upper plates and between the two lower plates for AC coupling of the plates.

During initial rotation of the plug within the connector a counterforce tends to return the plug to a nonrotated position. After partial rotation, the force on the plug is reversed such that the plug is positively driven through its full rotation. A preferred means of providing that reversing force on the rotating plug is a pawl pivoted on a wheel positioned below the shield enclosure. A leaf spring presses against the pawl to drive the wheel. As the wheel moves through a position at which the pawl presses radially outward against the spring, the force applied by the spring through the pawl is reversed. In the shielded embodiment, the spring biasing mechanism is positioned outside of the shield enclosure in order that the signal lines can be readily clamped between the shield plates.

The plug allows for significant shielding of the inner conductors of the coaxial wires leading to the node. To that end, a short length of the inner conductor of the node wire is exposed and electrically connected to a first fixed contact of the plug. A length of integral coaxial wire extends from the connected exposed inner conductor to a second fixed contact. A short length of the outer conductor is exposed at that second fixed contact and electrically connected thereto. Preferably, contact to the exposed outer conductor is made by an element which is crimped about the outer conductor. Plug contacts are connected to an end plate of the plug by shouldered rivets. The preferred plug includes four circumferentially spaced contacts from two coaxial wires.

BRIEF DESCRIPTION OF THE DRAWINGS

The foregoing and other objects, features and advantages of the invention will be apparent from the following more particular description of a preferred embodiment of the invention, as illustrated in the accompanying drawings in which like reference characters refer to the same parts throughout the different views. The drawings are not necessarily to scale, emphasis instead being placed upon illustrating the principles of the invention.

FIG. 16 is a plan view of the line closing conductors, taken along line 16—16 of FIG. 14;

FIG. 17 is a perspective view of a plug to be used with the connector of FIG. 14.

DESCRIPTION OF PREFERRED EMBODIMENTS

Figure 1:
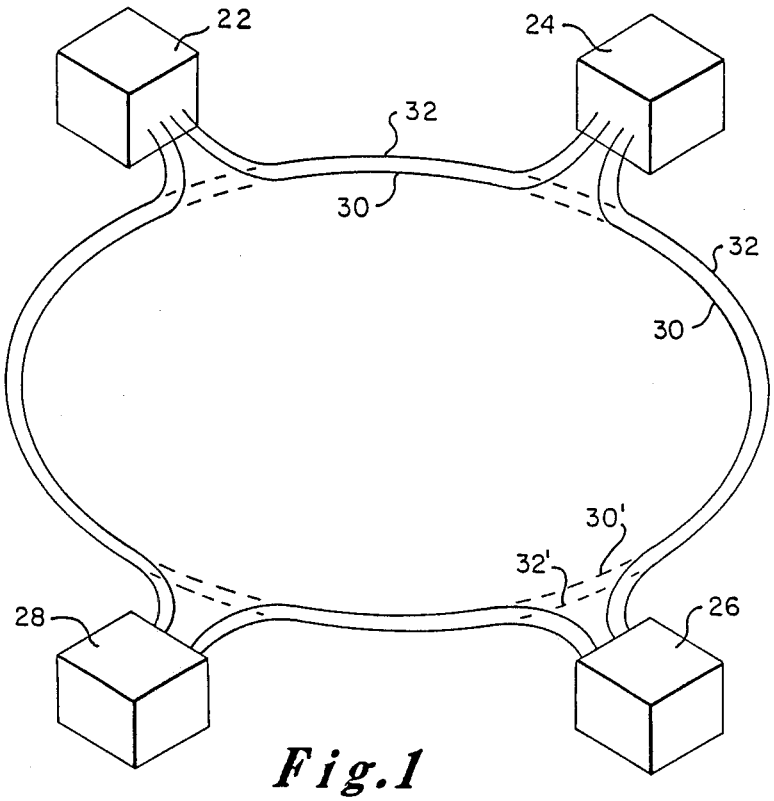
FIG. 1 is a schematic illustration of a ring network to which four communications nodes are connected.

A ring network is shown in FIG. 1. A number of communications terminals, or nodes, 22, 24, 26 and 28 are connected by means of a signal conducting path including signal lines 30 and 32. The signal lines and nodes form a ring through which all of the nodes communicate. Any break in the ring prevents communication within the network. Although only two signal conducting lines and four nodes are shown, it should be understood that any number of nodes and connecting lines might be provided.

Any node can be added to the network by disconnecting two lines in the ring as shown by the broken lines 30′ and 32′ and connecting the resulting four leads into the node. The node thus becomes an integral part of the ring. If a node is removed from the network, the ring is broken until it is reconnected directly at the broken lines 30′ and 32′. Such connecting and disconnecting of nodes generally results in a time in which the ring is broken and communication between any of the terminals in the network is precluded. This is a particular problem if a node is disconnected and the user fails to reconnect the ring lines. In that case, no communication is possible until the break in the ring is located and corrected.

Figure 2:
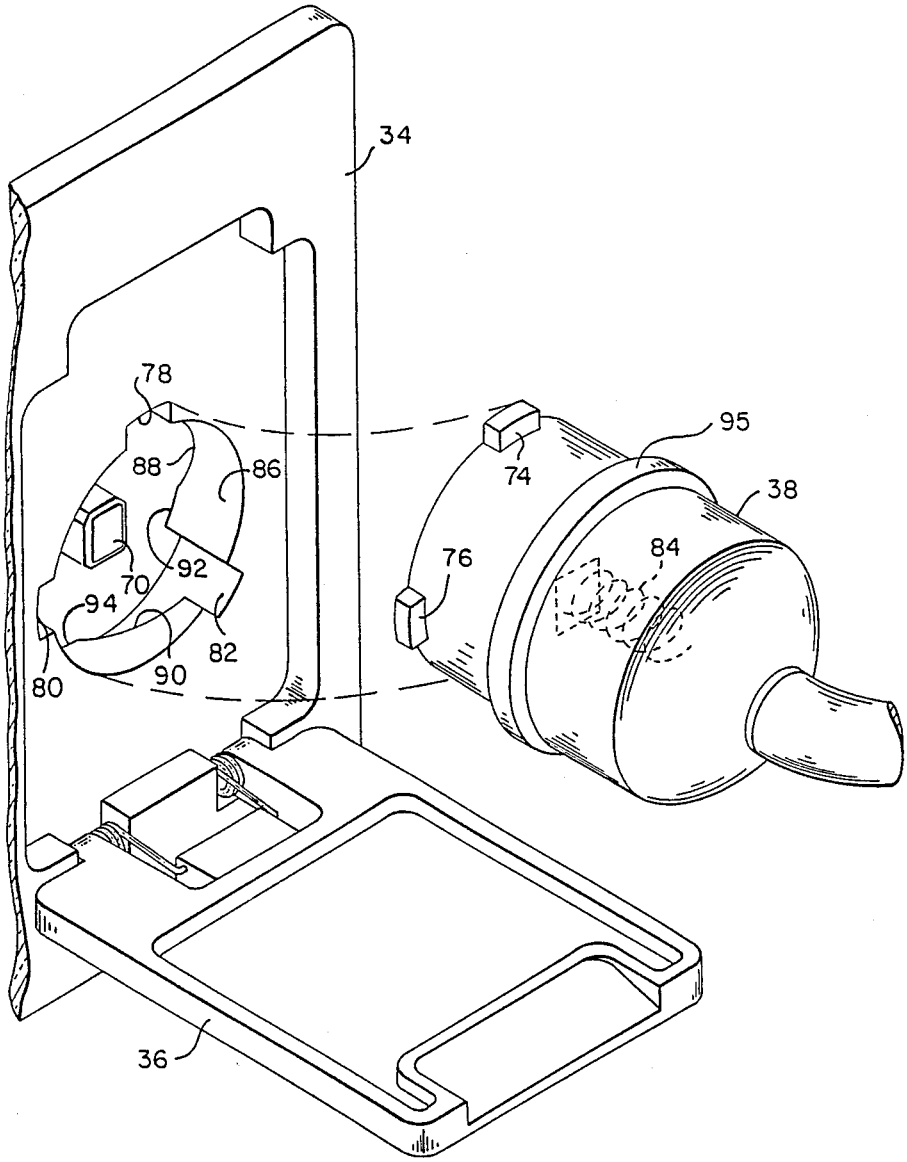
FIG. 2 is a perspective view of a connector embodying this invention and a plug from a node which is to be *connected into the ring network;*

In accordance with the present invention, connectors are provided in the signal lines 30 and 32 wherever it is likely that a node will be connected into the ring. As shown in FIG. 2, a connector 34 is preferably a wall mounted socket having a spring biased front closure 36. When a node is not connected to the ring network at the connector 34, the connector maintains the integrity of the ring network by closing the lines at 30′ and 32′. On the other hand, when a plug 38 from a node is properly connected into the connector the lines 30 and 32 are broken and reconnected through the plug 38 to the node.

Figure 3A:
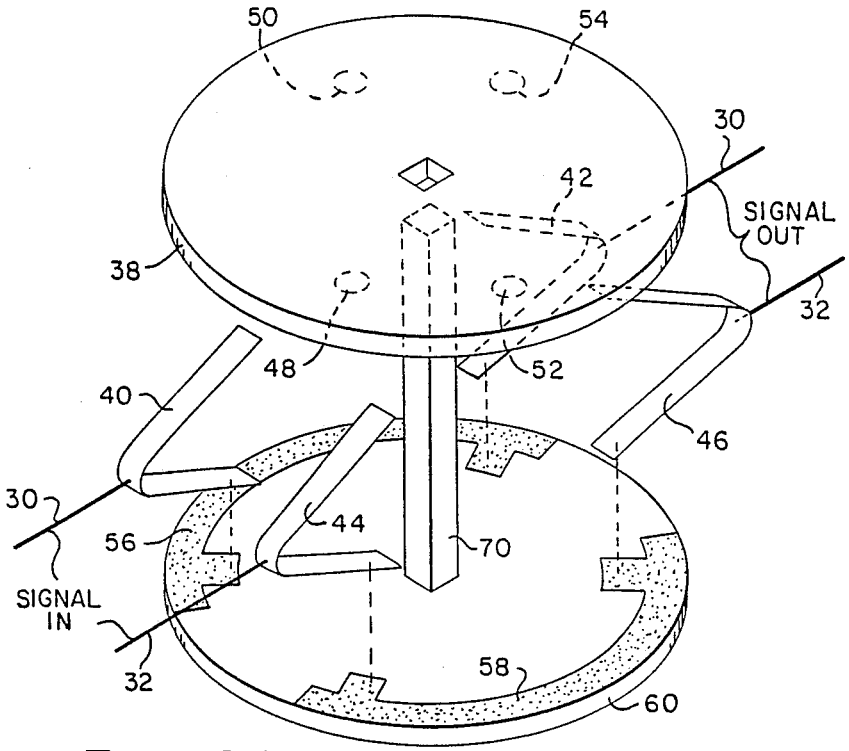
FIG. 3A is an exploded schematic illustration of plug contacts, rotating line closing conductors within the connector and leaf spring contacts within the connector prior to rotation of the plug.
Figure 3B:
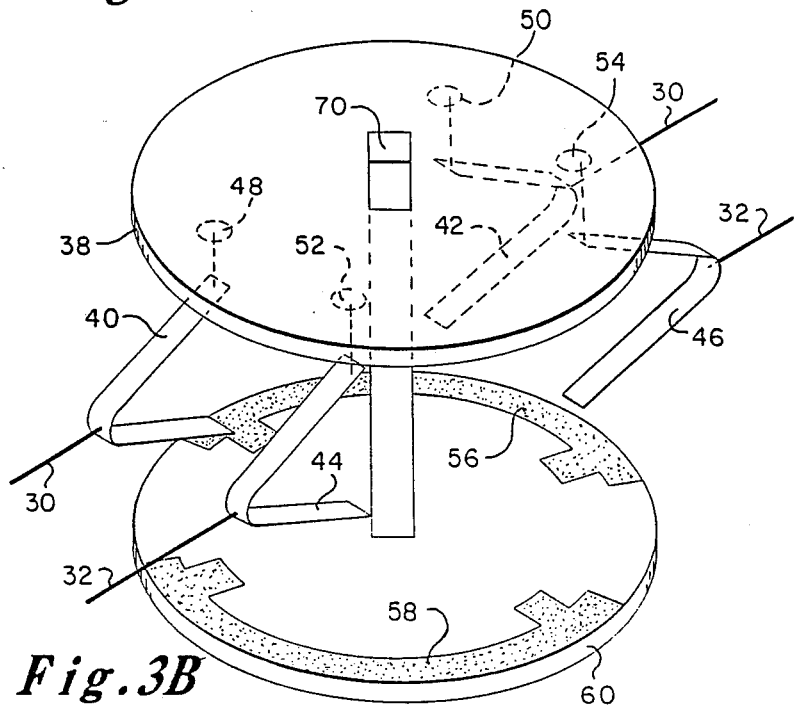
FIG. 3B is an illustration similar to FIG. 3A, but it illustrates connection of a node into the ring network with rotation of the plug in the connector.

A plug 38 from the node 22 (FIGS. 1 and 3) and a connector are shown schematically in FIGS. 3A and 3B. Connection of the node into the network and disconnection of the signal lines 30 and 32 is accomplished by means fo fixed, dual contact elements 40, 42, 44 and 46 connected to the four leads from lines 30 and 32 as shown in FIGS. 3A and 3B. Those line contacts cooperate with plug contacts 48, 50, 52 and 54, which are rotated once the plug is placed in the connector socket, and line closing conductors 56 and 58, which rotate on a wheel 60 with the plug. When the plug is initially inserted into the socket the lower edges of the leaf spring contacts 40, 42, 44 and 46 are in contact with respective contact points of the line closing conductors 56 and 58 as illustrated in FIG. 3A. Thus those conductors complete the circuit between the two leads of line 30 and the two leads of line 32.

When the plug is then rotated, as illustrated in FIG. 3B, it drives the wheel 60 through the squared shaft 70. With rotation the plug contacts 48, 50, 52 and 54 move into contact with the upper legs of the respective contacts 40, 42, 44 and 46 as the lower legs of those contacts move out of electrical contact with the line closing conductors. Thus, the direct connection of signal lines 30 and 32 through conductors 56 and 58 is broken. But line 30 is completed through line contact 40, plug contact 48, the node 22, plug contact 50, and line contact 42. Similarly, line 32 is completed through line contact 44, plug contact 52, the node 22, the plug contact 54 and line contact 46.

When the plug is rotated back to the position of FIG. 3A, the node is again disconnected and the lines 30 and 32 are connected directly through conducting bars 56 and 58.

The plug is provided with three radial tabs such as 74 and 76 in FIG. 2. Those tabs are of different sizes and they serve as keys which match slots 78, 80 and 82 of the connector socket. These keys assure that the plug contacts are properly aligned with the leaf spring contacts of the connector. The plug is pressed onto the shaft 70 against the force of a coil spring 84 within the plug. Once the keys on the plug are moved in beyond the outer plate 86 of the connector the plug can be rotated 45 degrees. During rotation the tabs 74 and 76 are guided by cam surfaces such as 88 and 90 which pull the plug in against the force of the coil spring 84. At the completion of the 45 degrees of rotation, the plug tabs rest on flats such as 92 and 94. The coil 84 pulls the plug outwardly against those flats so that the plug is held firmly within the socket and the axial relationship of the plug contacts to the line contacts is precisely controlled. A collar 95 on the plug prevents excessive axial movement of the plug into the connector.

Figure 4:
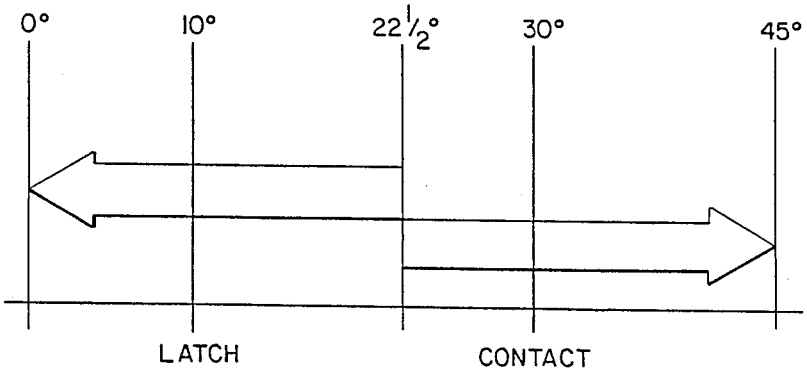
FIG. 4 illustrates the forces applied to the plug during a full 45 degree rotation within the connector socket.

The 45 degree rotation of the plug is shown in a linear diagram in FIG. 4. After 30 degrees of rotation, contact is made between the plug contacts 48, 50, 52 and 54 and the upper sections of the line contacts 40, 42, 44 and 46. At about the same position, contact between the lower sections of the line contacts and the line closing conductors 56 and 58 is broken. It can be seen, then, that there is a point during the rotation at which one set of contacts is closed and the other is opened to reroute the signal conducting path. As will be discussed, the plug is caused to move rapidly through that point so the effect on the system is minimal.

In order to assure that the plug is rotated the full 45 degrees to make contact with the node and to break contact with the line closing conductors, a mechanism is provided to bias the plug at all times either toward full rotation or back to a point of zero rotation at which the key tabs are aligned with the key slots. When the plug is released at this latter position, it falls from the socket under the force of the coil spring 84. As shown in FIG. 4, until the plug is rotated 22½ degrees, a spring force is applied to the plug to rotate it back towards the zero rotation position. Therefore, if the plug is released before it is rotated 22½ degrees, it is automatically returned to the zero rotation position and it falls from the socket. No changes in electrical connections will have been made in the system. If, however, the plug is rotated beyond 22½ degrees and is then released, the plug is driven in the opposite direction so that it is rotated the full 45 degrees and the node is properly connected into the ring. The opening and closing of contacts takes place at 30° when the plug is being positively driven toward the 45° position. Therefore, rerouting of the signal path occurs nearly instantaneously, and hang up of the connector at a point where both or neither of the alternative signal paths are completed is precluded.

As will also be discussed further below, a mechanism is provided to assure that a node plug is in the connector socket when the shaft 70 and wheel 60 are rotated. Otherwise, the shaft 70 might be grasped and rotated within the socket to disconnect the line closing conductors with no plug in the socket to connect a node. To prevent such rotation of the shaft and wheel, a latch, described below, is provided to prevent rotation beyond 10 degress unless the latch is opened by the tab 74.

The actual mechanism of the preferred connector is shown in FIGS. 5–13. As shown in the elevational cross sectional view of FIG. 5, the wheel 60 is positioned within a bottom housing 100. The housing 100 is closed by a plate 102 which also supports the fixed, line contacts 40, 42, 44 and 46. Those contacts are U-shaped leaf springs. The lower legs of the line contacts extend below the plate 102 to make contact with the line closing conductors 56 and 58 on the wheel 60. The upper legs of the line contacts extend above the plate 102 where the plug contacts can be moved into contact with them. The shaft 70 which supports the wheel 60 rotates in bearings 104 and 106 in the plate 102 and housing 100. As previously noted, a squared hole in the end of the plug fits over the shaft 70 so that the shaft and the wheel 60 rotate with the plug.

Figure 6:
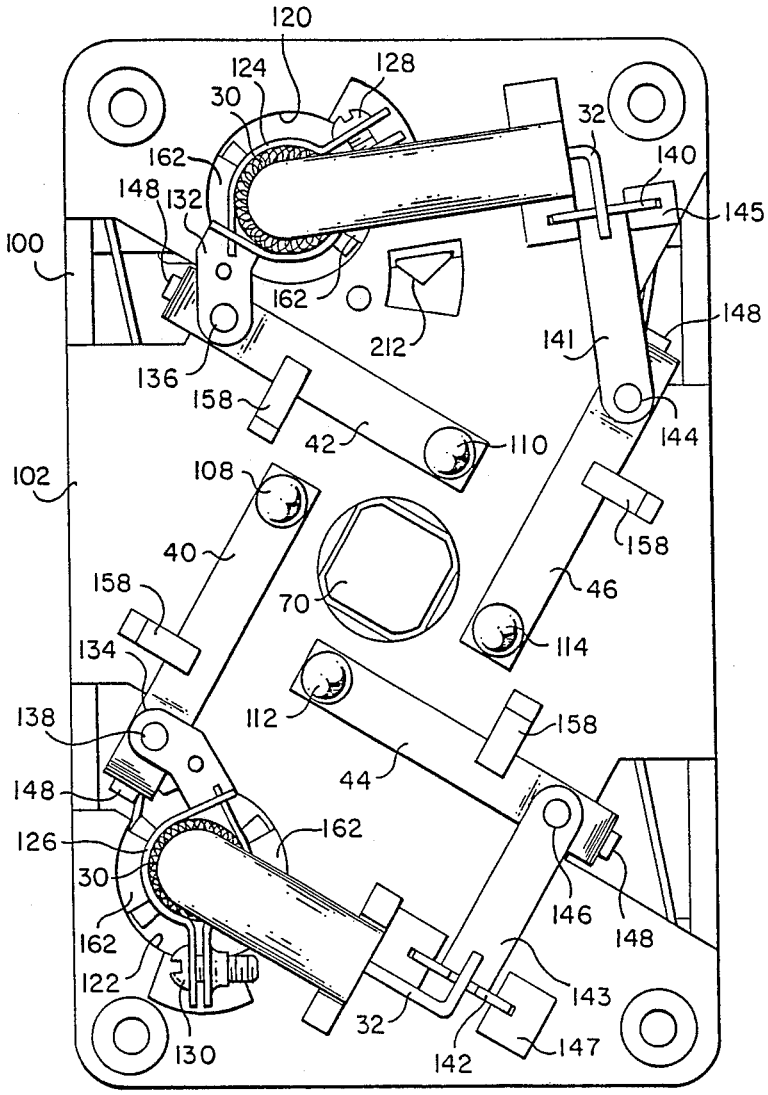
FIG. 6 is a cross sectional view of the connector of FIG. 5 taken along line 6—6 and showing a plan view of the fixed, line contacts seen by the plug.

The arrangement of the line contacts is best shown in FIG. 6. Each extends tangentially from the circular path followed by the plug contacts. Thus, as the plug is rotated clockwise, the plug contacts ride onto the contact points 108, 110, 112 and 114 of the line contacts.

The two coaxial cables which serve as signal lines 30 and 32 extend through openings 116 and 118 in the base of the housing 100. They pass through the housing 100 and continue through the openings 120 and 122 in the plate 102. The outer braiding of the coaxial cables, which form the signal lines 30, are clamped by respective clamps 124 and 126 which are fastened by bolts 128 and 130. Support arms 132 and 134 of the clamps are joined to the line contacts 42 and 40 may be means of rivets 136 and 138. Those rivets also secure the clamps and the contacts to the plate 102.

The center conductors 32 of the two coaxial cables are pressed into V-slots in vertical legs 140 and 142 of connectors 141 and 143. Those connectors are riveted to the line contacts 46 and 44 and the plate 102 by rivets 144 and 146. The vertical legs are set in retainer blocks 145 and 147.

Figure 7:
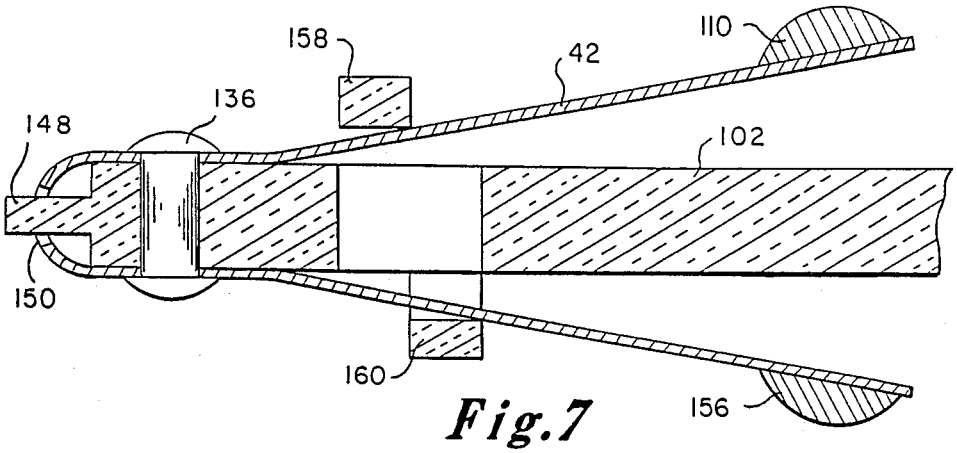
FIG. 7 is an enlarged elevational section showing a contact leaf spring.
Figure 8:
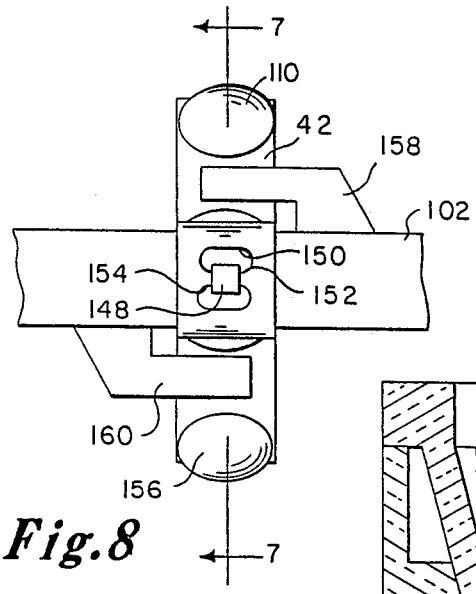
FIG. 8 is an end view of the contact leaf spring of FIG. 7.

The mounting of the line contacts is further illustrated by FIGS. 7 and 8. Each U-shaped leaf spring straddles the plate 102 at a cutaway from the plate. A tab 148 extends from the plate into the cutaway in a direction parallel to the legs of the leaf spring contact. The leaf spring is then positioned on the plate 102 as shown in FIG. 7 with the tab 148 extending through a slot 150 at the center of the spring. As shown in FIG. 8, that slot includes prongs 152 and 154 which grip the tab 148. The tab 148 prevents rotation of the leaf spring contact about the rivet 136.

In order to allow for precise positioning of the contact points 110 and 156, each leg of the leaf spring contact is compressed toward the plate 102 by a respective arm 158, 160 formed on the plate 102. That precise positioning enables precise setting of the angle at which contact is made or broken. It also ensures that the contact points do not scrape any non-metallic parts. Such scraping would result in contamination of the contact points, so the points are suspended in air when they are not making electrical contact. Further, the arms 158, 160 prestress the leaf spring contacts so that adequate contact pressure is immediate. This minimizes electrical resistance of the contact immediately.

Figure 9:
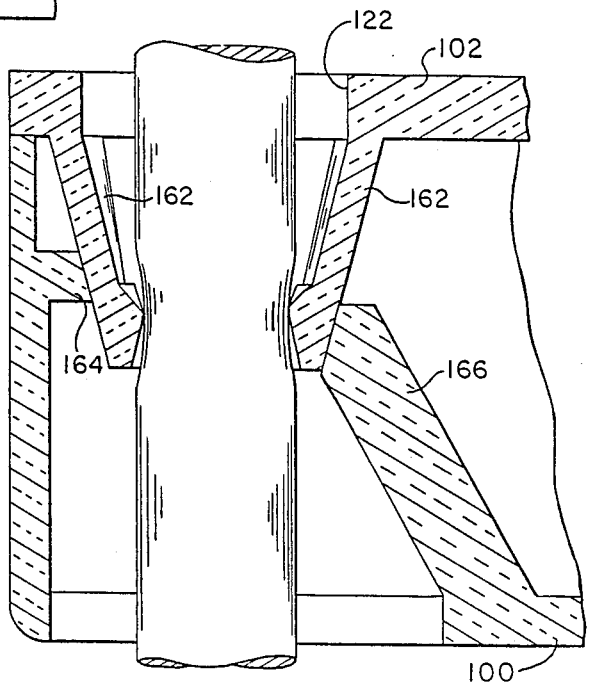
FIG. 9 is an elevational sectional view of a clamping mechanism for clamping the coaxial line leading into the connector.

As best shown in FIG. 9, the plate 102 is provided with two downwardly extending legs 162 at each of the openings 120 and 122 through which the coaxial cables extend. Those legs are pressed into the insulation of the cables by legs 164 and 166 on the housing 100 when the plate 102 is secured to the housing. This provides a mechanical clamp on the cable to eliminate any stresses on the electrical connections to the coaxial cable.

Figure 10:
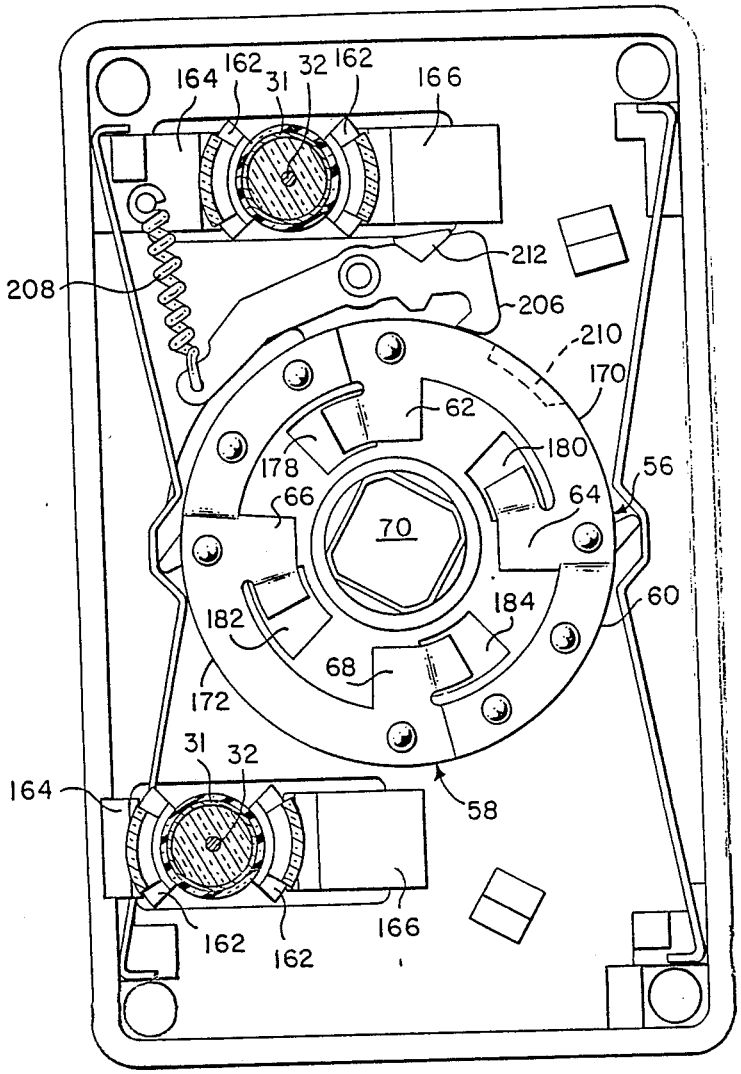
FIG. 10 is a cross sectional view of the connector taken along line 10—10 of FIG. 5 and showing a plan view of the line closing conductors.
Figure 11:
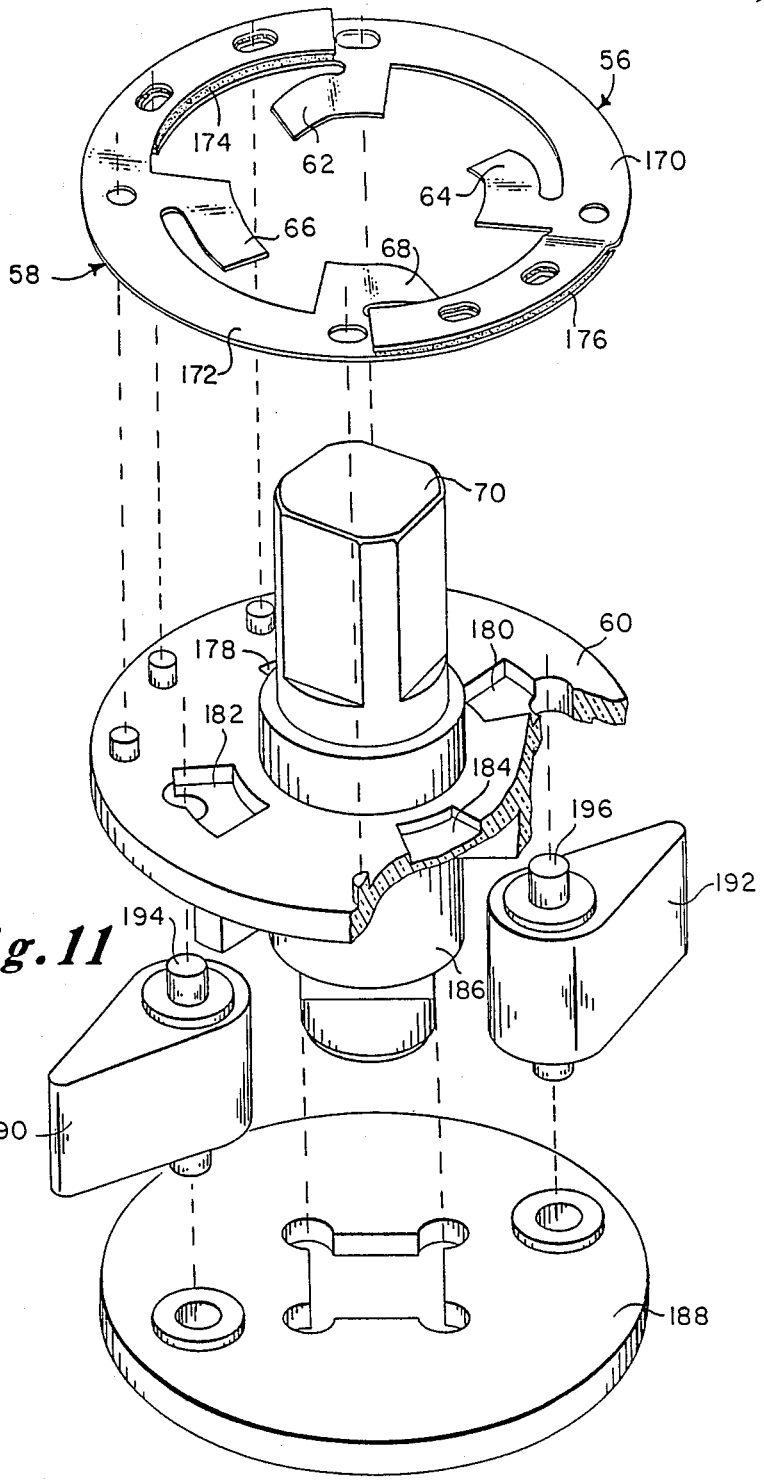
FIG. 11 is an exploded view of the line closing conductors and the spool to which they are mounted.

A plan view of the line closing conductors 56 and 58 on the wheel 60 is shown in the cross sectional view of FIG. 10, and the conductors are also shown in the exploded view of FIG. 11. Each conductor has two legs 62, 64 and 66, 68 extending inwardly from a circumferential shorting bar 170, 172. Cam surfaces are provided on the legs 62, 64, 66 and 68 by bending those legs into grooves 178, 180, 182 and 184 in the wheel 60.

When a plug is not positioned in the connector socket and the wheel 60 is thus at its zero degree rotation position, the contact points of the lower legs of the line contacts 40, 42, 44 and 46 rest on the legs 62, 64, 66 and 68. The center conductors 32 of the two coaxial lines leading into the connector are therefore connected through line contact 46, leg 68, shorting bar 172, leg 66, and line contact 44. The outer conductors 30 are connected through line contact 40, leg 62, shorting bar 170, leg 64 and line contact 42. There is therefore a continuous electrical connection between the signal lines 30 of the two coaxial cables and between the signal lines 32 of the two cables.

When the plug, and thus the wheel 60, is rotated 45 degrees, the line closing conductors 56 and 58 are moved into the positions shown in FIG. 10. In those positions, the legs 62, 64, 66 and 68 are moved away from the lower legs of the line contacts so that the contact points of the line contacts are positioned between the legs of the conductors 56 and 58 and are electrically insulated from them by air gaps. The plug contacts, on the other hand, are moved into contact with the upper legs of the line contacts.

In order to impedance match the connector with the coaxial cables, sections of the line closing conductors 56 and 58 overlap. The conductors are separated by dielectrics 174 and 176 to form capacitors between the two conductors. These capacitors are sized to provide the connector with a 75 ohm impedance which matches the impedance of the coaxial cables.

Figure 5:
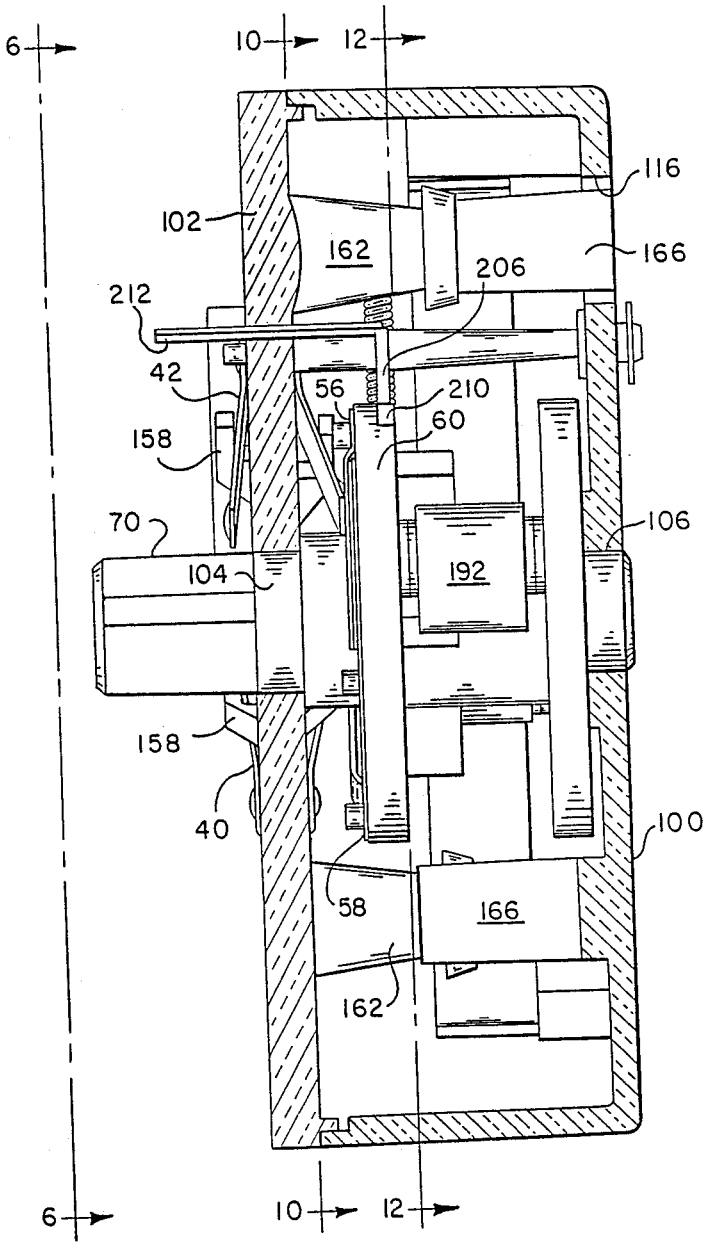
FIG. 5 is an elevational cross sectional view of the connector of FIG. 2.
Figure 12:
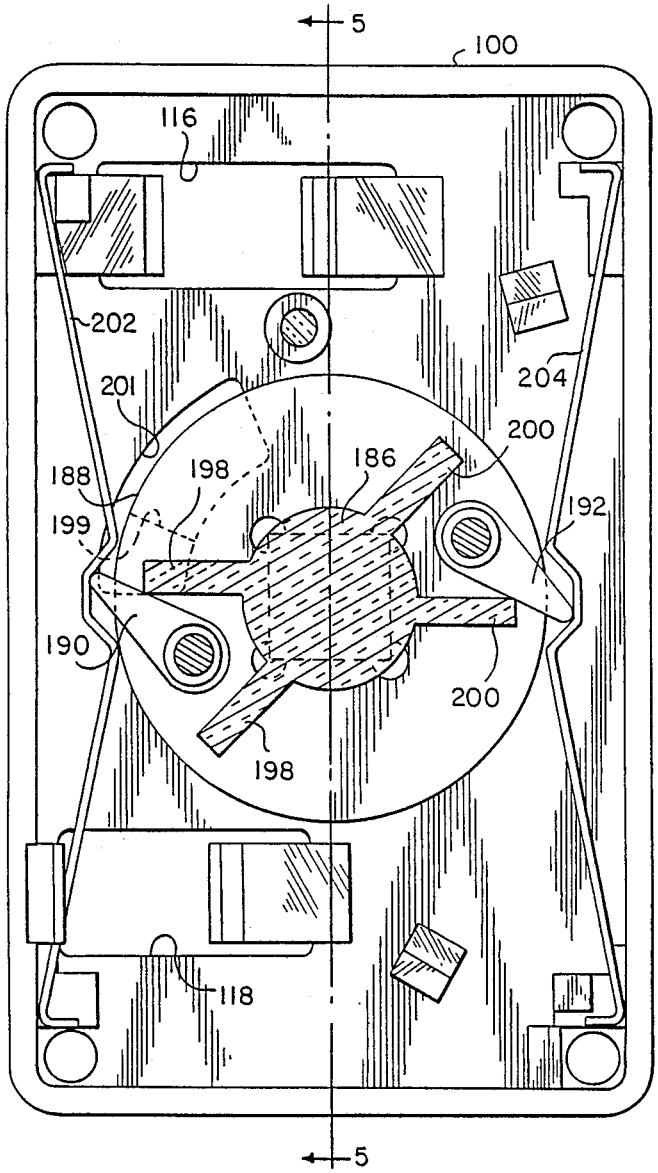
FIG. 12 is a cross sectional view of the connector taken along line 12—12 of FIG. 5 and showing the pawl and leaf spring mechanism for driving the spool within the connector.
Figure 13:
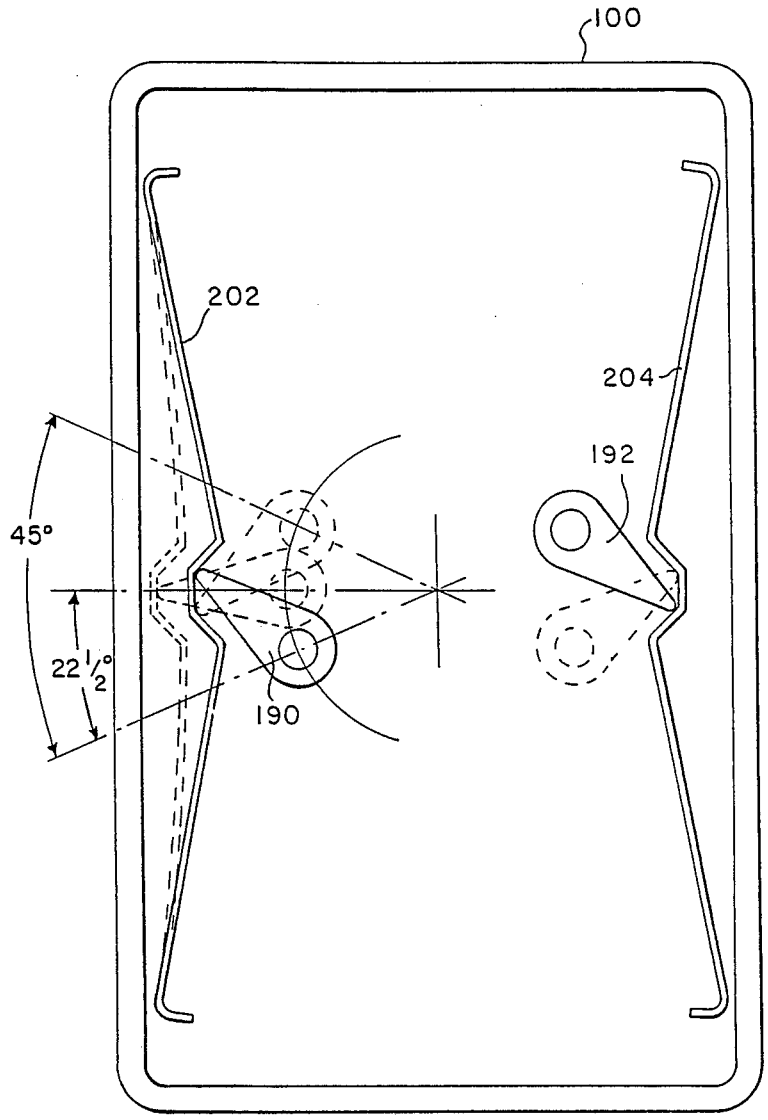
FIG. 13 is a schematic illustration of movement of the pawls and leaf springs of FIG. 12.

The mechanism for spring biasing the wheel 60 toward the zero degree and 45 degree positions is best shown in FIGS. 11 through 13. As can be seen in FIGS. 5 and 11, the wheel 60 is the upper flange of a spool. The spool is formed by the wheel 60 which is mounted to a hub 186 and by a lower wheel 188. The lower wheel is friction fit to a squared section of the center shaft 70. Two pawls 190 and 192 are mounted between the wheels 60 and 188 and pivot on shafts 194 and 196. These shafts ride in holes in the wheels 60 and 188. Rotation of the pawls 190 and 192 is limited by respective walls 198, 200 which extend outwardly from the hub 186 between the wheels 60 and 188. Rotation of the wheels is in turn limited to 45 degrees by a stud 199 which extends from the wheel 188 into a slot 201 in the floor of the housing 100.

The pawls extend beyond the outer peripheries of the wheels 60 and 188, and their tips are positioned in recesses formed in respective leaf springs 202 and 204. Those leaf springs are held in compression against the walls of the housing 100 by the pawls. Thus, the leaf springs exert a rotational force on the pawls to drive the spool. Further rotation is prevented by the walls 198, 200 in combination with the stud 199 in slot 201.

The wheels and pawls are shown at zero degree rotation in FIG. 12; that is, no plug is inserted into the connector. Because the springs 202 and 204 are in compression, the spool in the connector is positively held at the 0° position. When a plug is inserted onto the upper end of the shaft 70 and rotated, the wheels 60 and 188 are rotated clockwise as shown in FIG. 12 and movements of the pawls 190 and 192 and the leaf springs 202 and 204 is as shown in FIG. 13. For example, the pawl 190 presses the leaf spring 202 toward the wall of the housing 100 as it rotates counterclockwise with clockwise rotation of the wheels. Until the pawl reaches the center position shown in broken lines at 22½ degrees, the spring 202 exerts a force on the pawl 190 which drives the wheels counterclockwise back toward the zero degree position. Once the pawl passes the dead center position at 22½ degrees, the lead spring 202 drives the pawl counterclockwise so that it drives the wheels in a clockwise direction to complete connection of the node to the ring network. When the wheels are stopped at the 45° position, the leaf springs 202 and 204 are still in compression so the spool is positively held at that position.

The pawl serves as a lever to drive the connector spool. Due to the small tip of the pawl, the small diameter of shafts 194 and 196, and the fit and surface characteristics of parts, friction of the assembly is low, and it is unlikely that the pawl will hang up in the dead center position at 22½ degrees. However, even if it were to do so, integrity of the ring network would be maintained through the line closing conductors. As previously shown in FIG. 4, contact to those conductors is not lost until 30 degrees of rotation. At 30 degrees the wheels are being positively driven in a clockwise direction.

As was noted above, a latch is provided to prevent rotation of the wheels unless a node plug is rotated in the connector. That latch mechanism is shown in FIG. 10. In this view, the wheel 60 is rotated 45 degrees into the node connecting position. A latch hook 206 is held out in a nonlatched position by the outer rim of the wheel 60. A tension spring 208 holds the hook against the wheel 60. When the wheel is rotated back to the zero degree rotation position, the hook 206 falls into a slot 210 formed in the rim of the wheel 60. If the wheel is subsequently rotated back in a clockwise direction, the hook 206 prevents rotation beyond 10 degrees unless it is first moved to the outer position shown in FIG. 10. To open the latch, the tab 74 on the plug strikes the cam 212 which extends through the plate 102. As the key tab 74 strikes the cam, the hook 206 pivots outward to release the wheel 60 for further rotation.

An alternative embodiment of the connector and an associated plug are shown in FIGS. 14 through 17. As in the primary embodiment, line contacts are fixed to the connector and line closing conductors are moved from those contacts as plug contacts are moved into position to connect a node. However, this embodiment does not provide many of the safeguards provided by the primary embodiment.

Figure 14:
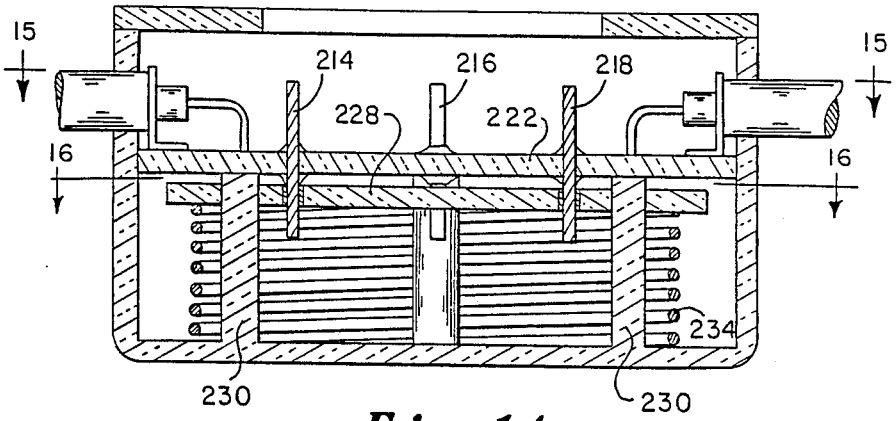
FIG. 14 is an elevational cross sectional view of an alternative embodiment of the invention.
Figure 15:
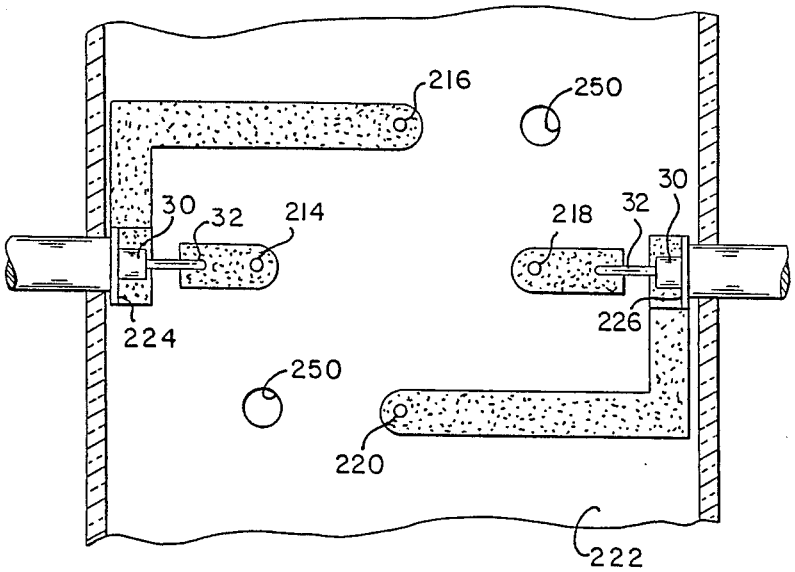
FIG. 15 is a plan view of the line contacts, taken along line 15—15 of FIG. 14.

As shown in FIGS. 14 and 15, the line contacts are four pins 214, 216, 218 and 220 which extend through and are fixed to a fixed plate 222. The plate 222 is a printed circuit board which connects the pins to the outer conductors 30 of two coaxial cables and the inner conductors 32 of those cables. The outer conductors 30 are joined through electrical connectors 224 and 226 to the pins 216 and 220. The inner conductors 32 are soldered to the printed circuit board to make an electrical connection to the pins 214 and 218.

When no plug is inserted into the connector, the lines 30 and 32 are completed through shorting conductors on a printed circuit board 228 shown in FIGS. 14 and 16. Four posts 230, which extend axially from the base of the connector housing, extend through holes 232 in the board 228. The board is free to move axially along those posts against the force of compression spring 234. The spring 234 presses the board 228 toward the stationary board 222 such that the line contact pins extend into electrical connector holes in the board 228. Specifically, pins 220 and 216 extend into connected holes 234 and 236, and the pins are connector by a line closing conductor 238 on the bottom face of the board 228. Pins 214 and 218 extend through connector holes 240 and 242 and are connected by the line closing conductor 244 on the upper face of the board 228.

As the plug of FIG. 17 is inserted into the connector, the ends of the line contact pins opposite to the plate 228 are inserted into respective connecting holes 246 in the plug. Simultaneously, studs 248 extend through holes 250 in the fixed board 222 (FIG. 15) and press against the board 228. As the plug is fully inserted, the studs 248 press the board against the compression spring 243 to move the board away from electrical contact with the line contact pins. Thus, connection of the signal lines from the coaxial cables is made through the plug to the node and direct connection between the coaxial cables is broken. The length of the studs 248 and the contact pins 214, 216, 218 and 220 established the timing of making and breaking contact in the system.

The embodiment of FIGS. 3 through 13 suffers from some stray signal on the outer conductor of the coaxial signal lines which may cause a system to fail the FCC Part 15 standard for electromagnetic emissions. To minimize that stray signal, the shielded connector assembly of FIGS. 18–21 has been developed. In this arrangement, all connections to the coaxial signal lines are made within a shielded enclosure. The enclosure is formed by four electrically conductive plates 302, 304, 306 and 308. First upper and lower plates 302 and 304 are electrically connected to the outer conductor 310 of a first coaxial signal line 312, and second upper and lower plates 306 and 308 are electrically conducted to the outer conductor of a second coaxial signal line 314. The two sets of upper and lower plates are electrically isolated but are closely spaced along gaps 316 and 318. The upper plates are mounted to an electrically insulating support plate 320 and the lower plates are mounted to an insulating support plate 322. The upper and lower plates are pressfit to each other to form good electrical contact along sides 326, 328 and 330, 332. (The terms upper and lower are, of course, relative and are used here for convenience and not to limit the orientation of the connector.)

Figure 20:
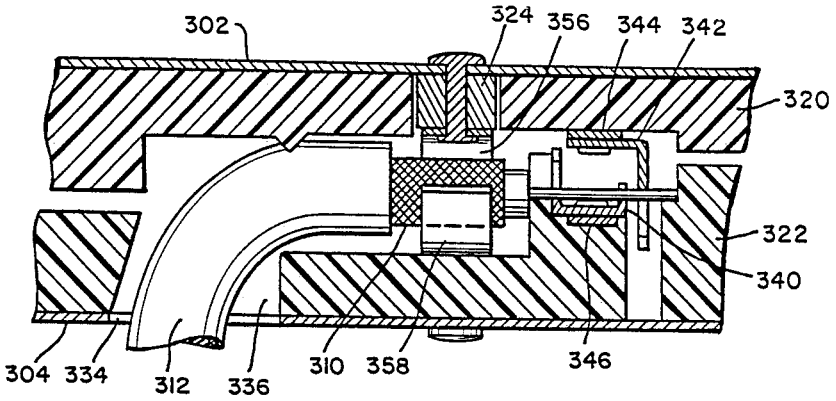
FIG. 20 is a sideview of the electrical connections made to the coaxial signal lines within the shielded enclosure of FIG. 18.

The coaxial signal lines are brought into the shielded enclosure through holes 334 in the lower shield plates and holes 336 and 338 in the lower support plate. Within the enclosure, the signal lines are bent over such that their ends are directed parallel to the shield plates. As shown in FIG. 20, a short end of the inner conductor of the shielded wire is pressed into two sets of finger clamps 340 and 342 to make contact with those clamps. The finger clamps are mounted to respective upper and lower line contacts 344 and 346 and to the upper and lower support plates 320 and 322. Similarly, the center conductor of the coaxial signal line 314 is connected to finger clamps 348 and 350 mounted to respective upper and lower line contacts 352 and 354.

A short length of the outer conductor of the coaxial wire 312 is stripped of insulation and pressed between a pair of shield clamps 356 and 358 which are pressed against the outer conductor when the two support plates 320 and 322 are assembled. The clamps 356 and 358 are riveted through the insulating plates 320 and 322 to the upper and lower shields 302 and 304 so that the outer conductor of the wire 312 is in electrical contact with both the upper and lower shield plates. Similarly, the outer conductor of wire 314 is clamped between clamps 360 and 362 which are riveted to the second pair of upper and lower shield plates 306 and 308. The remaining four line contacts are connected to respective shield plates. Specifically, upper line contact 364 is riveted to the upper shield plate 302 and lower line contact 366 is riveted to lower shield plate 304 such that both contacts 364, 366 are in electrical contact with the outer conductor of the signal line 312. Line contact 368 is riveted to the upper shield plate 306 and line contact 370 is riveted to the lower shield plate 308 such that those two line contacts are in electrical communication with the outer conductor of signal line 314.

The upper line contacts protrude through respective holes in the upper support plate 320 and upper shield plates 302 and 306 so that they are exposed for making contact to the four corresponding plug contacts.

Figure 21:
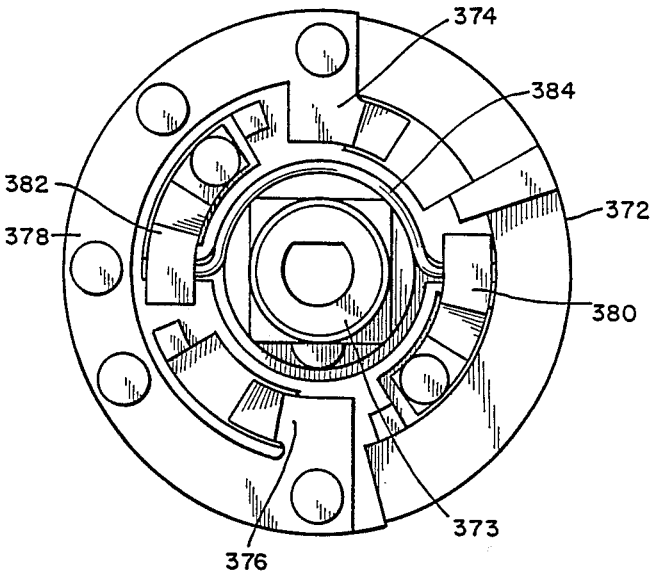
FIG. 21 illustrates the line closing conductors positioned on the rotor within the shielded enclosure of FIG. 18.

In this embodiment, the line closing conductors are mounted to the lower surface of a rotor 372 driven by a center shaft 373. Because the line contacts are reoriented in this embodiment, the line closing conductors are laid out differently from those in the previous embodiment as illustrated in FIG. 21. The conductors shown in FIG. 21 are mounted to the lower surface of the rotor 372. In this arrangement, opposite legs 374 and 376 are connected by a 360 degree shorting bar 378; legs 380 and 382 are connected by a length of wire 384 soldered to each of those legs. The four legs lie on the same circle and are bent into cavities within the rotor 372 to provide cam surfaces as in the previous embodiment.

Prior to connection of a node plug into the connector, the outer conductors of the two coaxial signal lines are directly coupled through the shorting bar 378, and the inner conductors are directing coupled through the wire 384. With rotation of the shaft 373 to bring the plug contacts into communication with the upper line contacts, the legs 374, 376, 380 and 382 are rotated away from the lower line contacts to break the direct connection of the coaxial signal lines.

As in the previous embodiment, rotation of the shaft 373 is influenced by springs which press against pawls positioned within a spool 388. This spring-biasing mechanism is the same as that previously described and will not be further described with respect to this embodiment. It is noted that the spool 388 is separated from the line closing conductor rotor 372 and the former is positioned outside of the shielded enclosure in a main housing 389.

Figure 18:
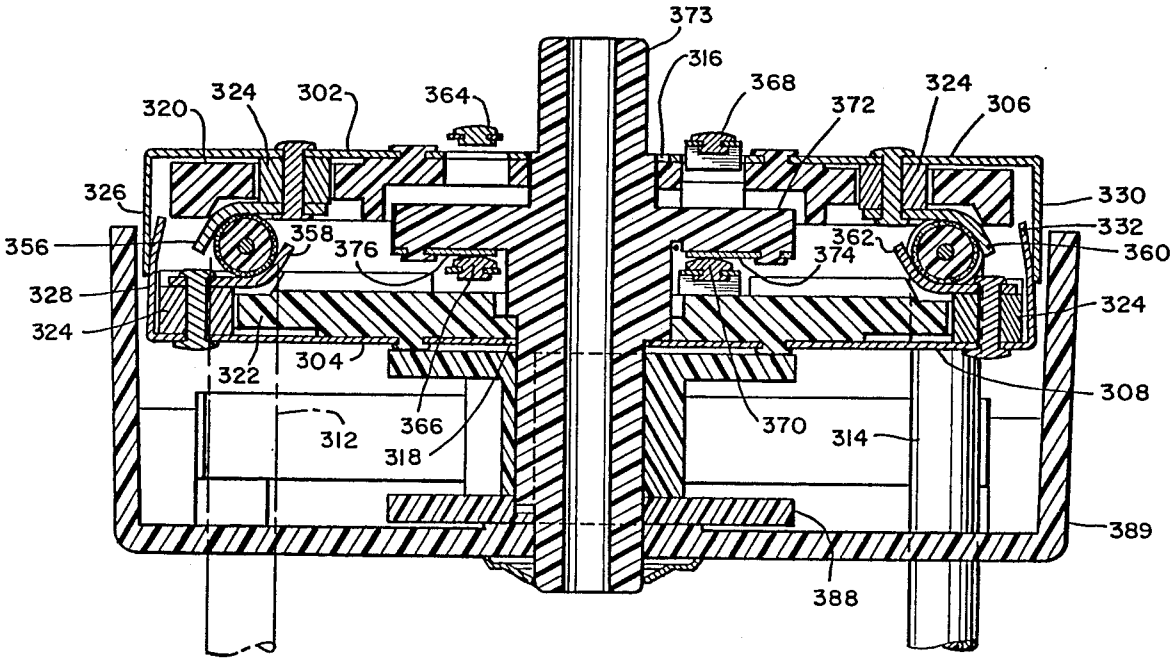
FIG. 18 is a cross-sectional view of a shielded connector embodying the present invention.
Figure 19:
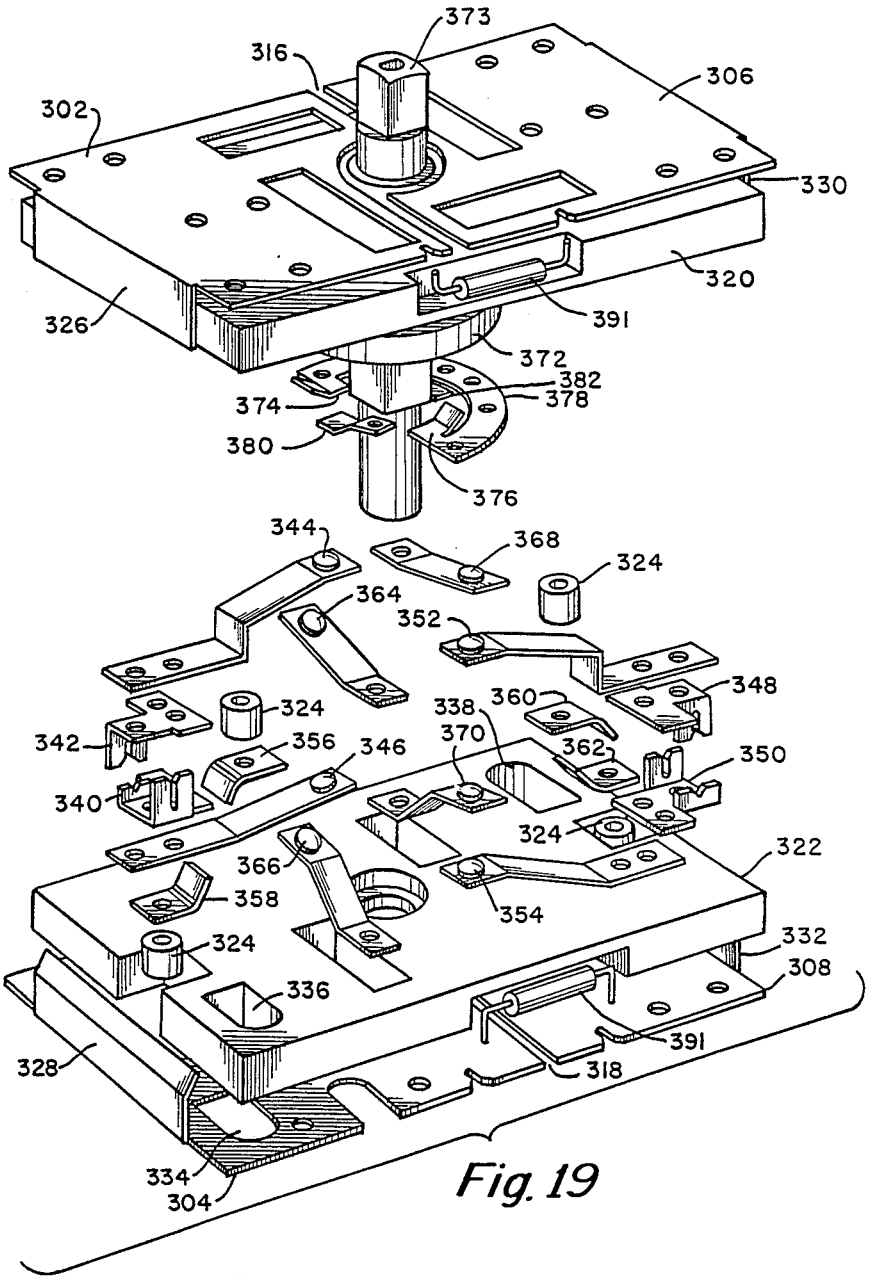
FIG. 19 is an exploded view of the shielded enclosure of FIG. 18 and the electrical elements positioned therein.

The effect of the line contact fingers within the parallel shielding plates is that of a stripline transmission line connecting the two coaxial signal lines. The capacitance and inductance of the connector can be established so that the connector stripline is impedance matched to the coaxial line. The capacitance of the connector, which results primarily from the capacitance between the parallel plates and the line contacts, is established in large part by the spacing between the parallel plates and by the amount of plastic material which has a higher dielectric constant relative to air. In the connector shown, the shield plates are spaced ½ inch apart. The inductance of the connector, on the other hand, is primarily determined by the dimensions of the long, thin line contacts. The connector shown in FIG. 18 provides a characteristic impedance of 75 ohms to match 75 ohm signal lines.

By positioning the spring biasing spool 388 below the shielded enclosure, this mechanical mechanism is isolated from the area in which a user must couple the signal lines. To connect signal lines to the connector, only the upper shield plates and their support need be removed, and coaxial cable can be readily positioned within the shielded enclosure in the manner illustrated in FIG. 20. Then, with replacement of the upper shield and its support, connection of the coaxial cable by means of the clamp 356 and the finger clamp 342 of FIG. 20 results automatically. The compact, shielded enclosure also permits the coaxial cable to be centered between the upper and lower shield plates and simply clamped without a complicated interior structure. The symmetry of the upper and lower line contacts within the shielded enclosure results in matched transmission lines whether the signal path is through a node or directly through the line closing conductors.

The shields which are connected to the respective signal lines are AC coupled through capacitors 391. Four such capacitors are provided, one positioned at each end of each slit between the two sets of shield plates. The capacitors provide a high impedance to low frequency currents, principally at 60 hertz, to prevent current flow through the network, but they present a low impedance to the high frequency of the 12 megabit network signal. Capacitors in the order of 0.1 microfarad are used. To simplify the design, discrete capacitors 391 are used. However, a distributed capacitance could be provided by overlapping the shield plates and providing a dielectric material therebetween.

Figure 22:
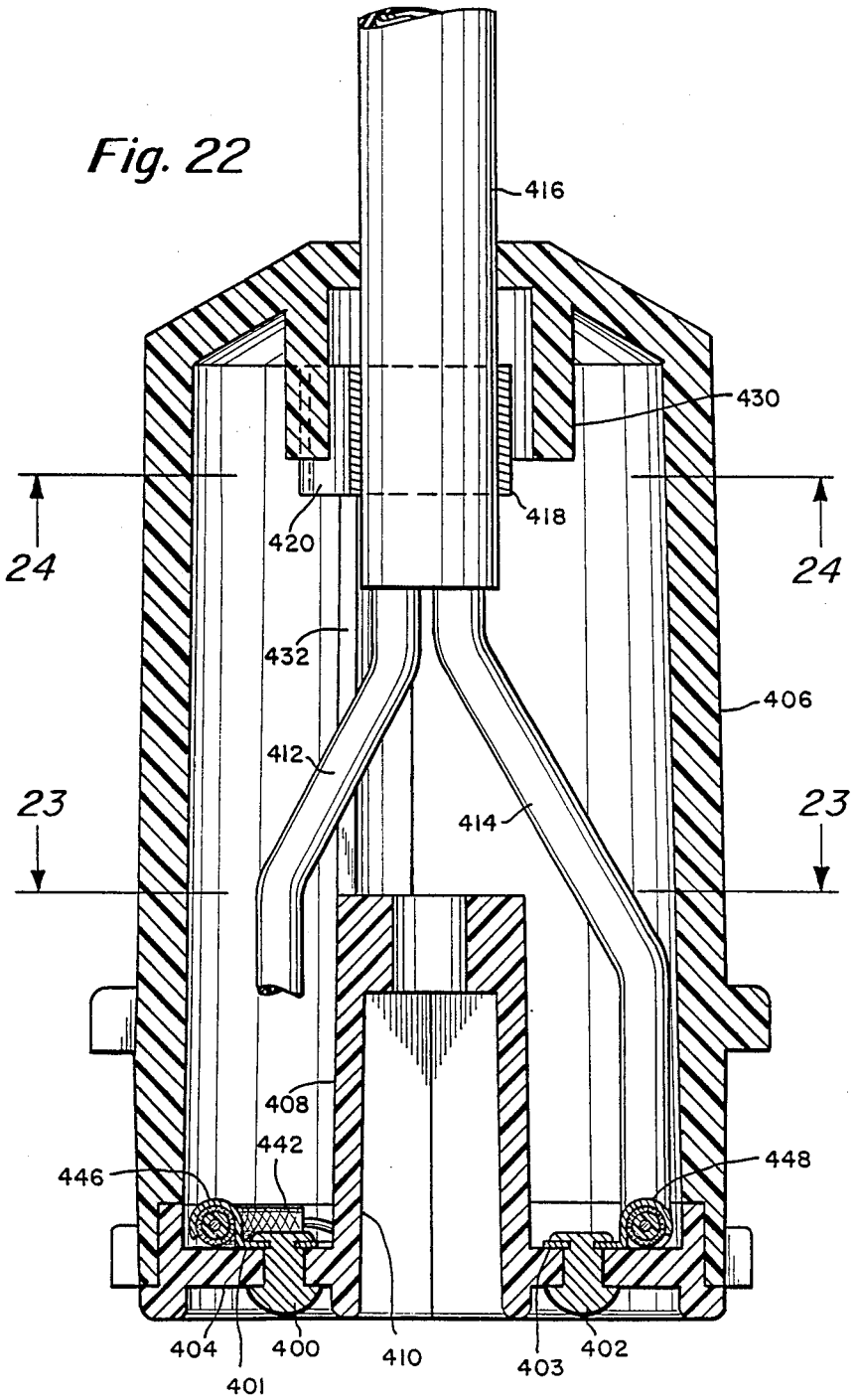
FIG. 22 is a longitudinal cross sectional view of a node plug used with the connector of FIGS. 18 through 21.
Figure 23:
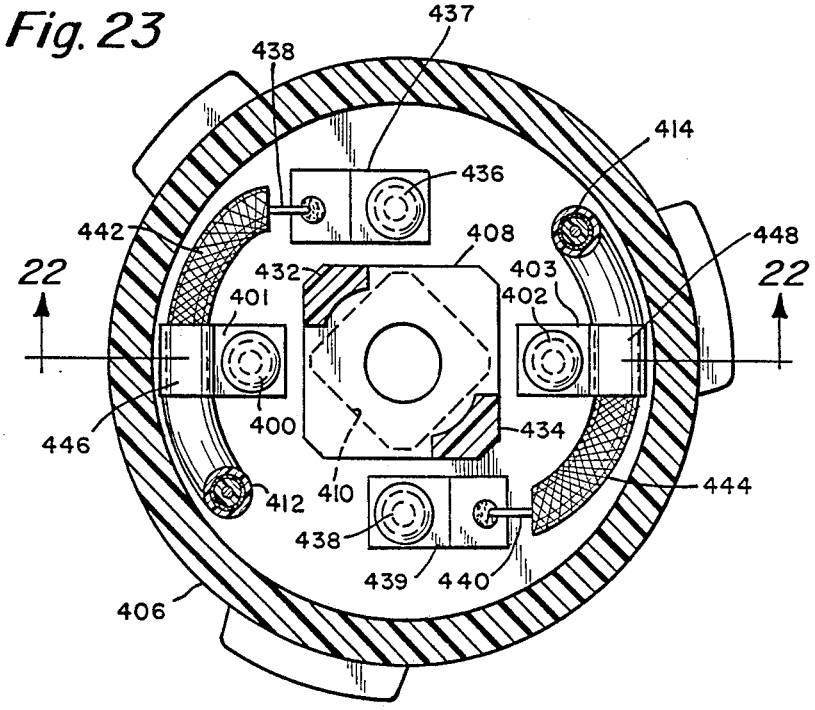
FIG. 23 is a cross sectional view of the plug of FIG. 22 taken along lines 23—23.
Figure 24:
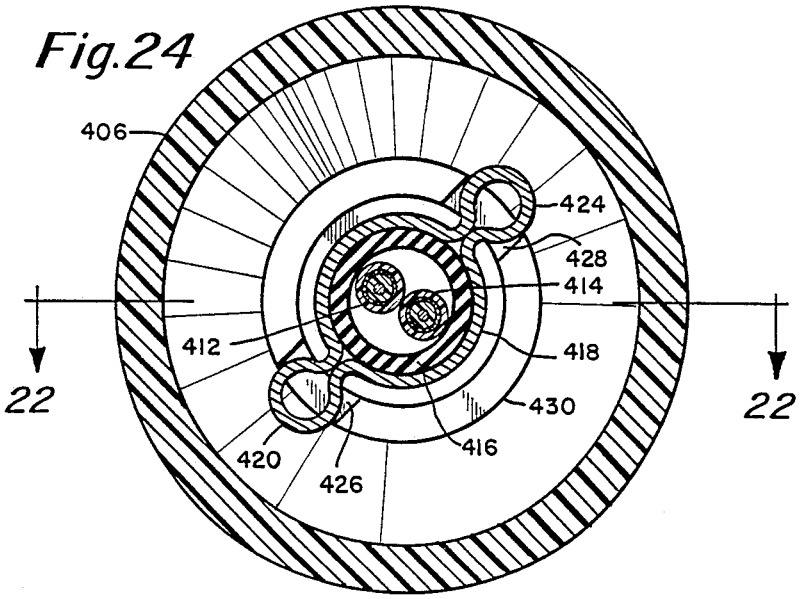
FIG. 24 is a cross sectional view of the plug of FIG. 22 taken along lines 24—24.

Although a shielded enclosure is not provided in the node plug, the plug is designed to maximize shielding with a minimization of complexity. As shown in FIGS. 22–24, plug contacts, 400, 402, 436, 438 are mounted to an insulating end cap 404 of a plug housing 406. The end cap 404 includes a hub 408 having a bore 410 of a square cross section which fits over the connector shaft 373 to drive that shaft. Two sets of coaxial node wires 412 and 414 are sheathed in a common cable 416. In assembly, the cable 416 is pulled through the end of the housing 406 and a ring 418 is crimped about the cable to form ears 420 and 424. Those ears fit into slots 426 and 428 in an upper hub 430. Those ears prevent the cable from being pulled back out of the housing. The ears are retained within the slots 426, 428 by two legs 432, 434 which extend upward from the end cap hub 408.

In a typical coaxial cable termination, the outer conductor of the coaxial wire is pulled away from the insulation surrounding the inner conductor and connected to one side of the cable. In the present configuration, where the four plug contacts 400, 402, 436 and 438 are circumferentially spaced, such an arrangement would result in an extended length of unshielded inner conductor. In the plug of FIGS. 22–24, the two inner conductors 438 and 440 are soldered or otherwise connected to their respective contacts. Only a short length of each inner conductor is exposed from the shielded cable. Lengths 442 and 444 of integral coaxial wire, including the shielding conductor and outer insulation, are provided between the exposed lengths of inner conductor 438 and 440 and the respective outer conductor contacts 400 and 402. At the latter contacts the insulation is stripped from the cable and clamps 446 and 448 are crimped about the exposed outer conductor. Thus, connection is made to the outer conductors at the contacts 400, 402 without interfering with the shielding provided by those conductors.

Each of the plug contacts is the head of a shouldered rivet which is fixed to a respective contact plate 401, 403, 437, 439. The shouldered rivets prevent strain on the plastic endcap during assembly.

While the invention has been particularly shown and described with reference to a preferred embodiment thereof, it will be understood by those skilled in the art that various changes in form and details may be made therein without departing from the spirit and scope of the invention as defined by the appended claims.

We claim:

1. In a communications network of the type having a plurality of communications nodes interconnected through at least one network signal conducting path wherein the network signal conducting path is broken and reconnected through a node signal conducting path when a node is connected into the network, the improved connector for permitting attachment and removal of nodes from the network without allowing an error-creating discontinuity of the network signal conducting path comprising:

line closing connector means adapted for connection into the network signal conducting path for opening and closing the network signal conducting path between input and output points;

node connecting means adapted for connecting and disconnecting the node signal conducting path to the network signal conducting path between said input and output points; and network connecting means responsive to said node connecting means for causing said line closing connector means to open and close the network signal conducting path such that the network signal conducting path is completed through said line closing connector means at substantially all times that a node is not connected into the network at the connector, said line closing connector means is disconnected from between said input and output points when said node connecting means connects the node signal conducting path to the network signal conducting path when a node is being attached to the network, and said line closing connector means is connected between said input and output points when said node connecting means disconnects the node signal conducting path from the network signal conducting path when a node is being disconnected from the network; the connector further comprising, a mounting socket containing said line closing connector means and said network connecting means;

a plug containing connectable ends of the node signal conducting path, said plug being adapted to fit into said mounting socket in a first point of orientation relative thereto and rotate therein between said first point and a second point, said plug further including activation means for engaging said network connecting means and for causing said network connecting means to open and close the network signal conducting path between said input and output points as said plug is rotated within said socket;

safety interconnect means operably connected to said plug and socket for locking said plug into said socket as said plug is rotated away from said first point; and, biasing means for applying a rotary biasing force against said plug towards said first point during rotation between said first point and a third point disposed between said first and second points, for applying a rotary biasing force against said plug towards said second point during rotation between said third point and said second point, for allowing said activation means to cause said line closing connector means to disconnect said input and output points only after said plug has been rotated past said third point in the direction of said second point; and for requiring said activation means to cause said line closing connector means to connect said input and output points before said plug has been rotated to said third point in the direction of said first point whereby said plug is biased towards a locked and electrically connected condition when inserted and rotated past said third point and is biased back towards an unlocked and releasable condition with electrical connection contact having not been made when inserted and not rotated past said third point.

2. A connector as claimed in claim 1 wherein:

said biasing means for rotating said plug comprises a pawl pivoted relative to said line closing connector means and a first spring for driving said line closing connector means, through said pawl, in opposite angular directions.

3. A connector as claimed in claim 2 and further comprising:

a second spring for forcing said plug from said socket when said plug is nonrotated in said first position in said socket.

4. A connector as claimed in claim 1 and further comprising:

latch means for preventing rotation of said line closing connector means, said latch means being releasable by a projection on said plug to permit further rotation of said line closing connector whereby rotation of said line closing connector by other than said plug as for an act of vandalism is prevented.

5. A connector as claimed in claim 1 and further comprising:

a plate positioned within said socket transverse to the axis of rotation of said plug;

first line contacts fixed to one side of said plate and positioned to make contact with plug contacts connected to the node signal connector path after rotation of said plug contacts in combination with said plug;

second line contacts fixed to the opposite side of said plate and positioned to contact the line closing connector means when said first line contacts have not made electrical connection to the plug contacts and to be disconnected therefrom when said first line contacts have made electrical connection to said plug contacts; and wherein, said line contacts are opposite legs of a U-shaped leaf spring mounted to said plate.

6. A connector as claimed in claim 5 wherein:

said legs of said U-shaped leaf spring are held in compression whether or not they are in contact with respective ones of said plug contacts and said input and output points.

7. A connector as claimed in claim 6 wherein:

said U-shaped leaf spring is pinned to said plate and a tab extends from said plate through a slot in the base portion of said U-shaped leaf spring between said legs.

8. A connector as claimed in claim 1 wherein:

said plug includes a collar for preventing excessive axial movement of said plug into said socket.

9. A network connector for connecting first and second coaxial signal lines, each having an inner and an outer conductor, either directly or through a node signal conducting path to complete a network signal conducting path, wherein direct connection of the coaxial signal lines is broken and the network signal conducting path is reconnected through the node signal conducting path when a node is connected into the network, the connector comprising:

a first pair of upper line contacts;

a first pair of lower line contacts;

a second pair of upper line contacts;

a second pair of lower line contacts;

means for connecting the inner conductor and outer conductor of the first coaxial signal line to respective first upper line contacts and to respective first lower line contacts;

means for connecting the inner conductor and outer conductor of the second coaxial signal line to respective second upper line contacts and to respective second lower line contacts;

rotatable line closing conductors for directly connecting and disconnecting the first and second inner conductors and for directly connecting and disconnecting the first and second outer conductors through the first and second pairs of lower line contacts;

means for initially locating a plug such that plug contacts thereon are angularly displaced from associated upper line contacts and for then allowing the plug contacts to be rotated to make contact with the upper line contacts; and means responsive to rotation of the plug contacts into and out of contact with the upper line contacts to rotate the line closing conductors out of and into contact with associated lower line contacts.

10. A connector as claimed in claim 9 further comprising rotary biasing means for applying a rotary biasing force to press the plug toward the initial angular position until the plug has reached a predetermined angular position and for thereafter applying a rotary biasing force press the plug toward a final angular position at which the plug contacts make contact with the upper line contacts.

11. A connector as claimed in claim 10 wherein the biasing means comprises a pawl pivoted relative to the line closing conductor and a spring for driving the line closing conductor, through the pawl, in opposite angular directions.

12. A connector as claimed in claim 10 in combination with a plug to be inserted into the connector further comprising an interlock on the plug to prevent removal of the plug from the connector after rotation of the plug.

13. A network connector for connecting first and second signal lines either directly or through a node signal conducting path to complete a network signal conducting path, wherein direct connection of the signal lines is broken and the network signal conducting path is reconnected through the node signal conducting path when a node is connected into the network, the connector comprising:

direct connecting means for directly connecting the signal lines through the connector;

node connecting means for connecting the signal lines to a node signal conducting path;

means responsive to connection of the signal lines to the node signal conducting path to break the direct connection of the signal lines through the direct connecting means; and an electromagnetic shield electrically coupled to the first and second signal lines and forming a shielded enclosure about the direct connecting means and the node connecting means in establishing a capacitance which impedance matches the connector to the signal lines.

14. A network connector as claimed in claim 13 wherein the first and second signal lines are coaxial signal lines having inner and outer conductors and the shield comprises parallel shield plates between which the coaxial signal lines are connected to the direct connecting means and the node connecting means.

15. A network as claimed in claim 14 wherein the parallel plates are split into first plates electrically coupled to the outer conductor of the first signal line and second plates electrically coupled to the outer conductor of the second signal line.

16. A network connector as claimed in claim 14 wherein the parallel plates are spaced by about ½ inch.

17. A network connector as claimed in claim 14 wherein the signal lines extend through lower ones of the shield plates into the space between the shield plates, and the node connection means protrudes through upper ones of the shield plates.

18. A network connector as claimed in claim 14 wherein the signal lines are clamped between upper and lower shield plates to make electrical connection to the connector.

19. A network connector as claimed in claim 18 further comprising a mechanism for spring biasing a plug coupled to the connector, the mechanism being positioned outside of the enclosure formed by the shield plates on the side thereof away from the plug.

20. A network connector as claimed in claim 14 further comprising capacitors coupling the outer conductors of the signal lines.

21. A network connector for connecting first and second coaxial signal lines, each having an inner and an outer conductor, either directly or through a node signal conducting path to complete a network signal conducting path, wherein direct connection of the coaxial signal lines is broken and the network signal conducting path is reconnected through the node signal conducting path when a node is connected into the network, the connector comprising:

a conductive shield forming a shielded enclosure, the shield comprising first generally parallel upper and lower shield plates and second generally parallel upper and lower plates, the upper plates being positioned in close side-by-side generally coplanar relationship to each other but being electrically isolated from each other and the lower plates being positioned in close side-by-side, generally coplanar relationship to each other but being electrically isolated from each other, such that the space between the upper and lower plates is the shielded enclosure;

a first pair of upper line contacts protruding through the upper shield plates;

a first pair of lower line contacts positioned within the shielded enclosure;

a second pair of upper line contacts protruding through the upper shield plates;

a second pair of lower line contacts positioned within the shielded enclosure;

means within the shielded enclosure for connecting the inner and outer conductors of the first coaxial signal line to respective first upper line contacts and to respective first lower line contacts and for connecting the outer conductor of the first coaxial signal line with the first upper and lower shield plates;

means within the shielded enclosure for connecting the inner and outer conductors of the second coaxial signal line to respective second upper line contacts and to respective second lower line contacts and for connecting the outer conductor of the second coaxial signal line with the second upper and lower shield plates;

movable line closing conductors positioned within the shielded enclosure for directly connecting and disconnecting the inner conductors of the final and second coaxial signal lines and for directly connecting and disconnecting the outer conductors of the first and second coaxial signal lines through the first and second pairs of lower line contacts; and means responsive to a plug moved into electrical contact with the first and second pairs of upper line contacts for connection through the node signal conducting path to move the line closing conductors into a position which disconnects the first and second pairs of lower line contacts.

22. A network connector as claimed in claim 21 wherein the movable line closing conductors are positioned on a rotor which is rotated in response to rotary motion of a plug moved from an initial angular position to a final angular position at which it is in electrical contact with the first and second pairs of upper line contacts.

23. A network connector as claimed in claim 22 further comprising an upper support plate on which the upper shield plates are mounted and a lower support plate on which the lower shield plates are mounted and wherein the line closing conductors are positioned on a lower surface of the rotor and the lower line closing contacts extend upwardly from the lower shield plates and support plates.

24. A network connector as claimed in claim 23 further comprising rotary biasing means positioned below the lower shield plates but coupled to the rotor for applying a rotary biasing force to press the plug toward the initial angular position of the plug until the plug has reached a predetermined angular position and for thereafter applying a rotary biasing force to press the plug toward the final angular position at which the plug contacts make contact with the line contacts.

25. A network connector as claimed in claim 24 wherein the biasing means comprises a pawl pivoted relative to the line closing conductor and a spring for driving the line closing conductor through the pawl in opposite angular positions.

26. A network connector as claimed in claim 21 further comprising an upper capacitor between the first upper shield plate and the second upper shield plate and a lower capacitor between the first lower shield plate and the second lower shield plate.

27. A network connector as claimed in claim 21 further comprising an upper support plate with the upper shield plates mounted to an upper surface thereof and a lower support plate with the lower shield plates mounted to a lower surface thereof.

28. A network connector as claimed in claim 27 wherein the coaxial signal lines extend through holes in the lower shield plates and the lower support plate and each coaxial signal line is bent within the shielded enclosure such that the signal line is oriented parallel to the shield plates.

29. A network connector as claimed in claim 28 wherein a short length of inner conductor of each coaxial signal line is exposed and electrically connected to the respective line contacts and a short length of outer conductor of each coaxial signal line is exposed and electrically connected to respective line contacts by complementary clamps mounted to the upper and lower support plates.

* * * * *